US010553187B2

(12) United States Patent
Boone

(10) Patent No.: US 10,553,187 B2
(45) Date of Patent: Feb. 4, 2020

(54) ADJUSTABLE DRUM SNARE AND TENSION ADJUSTMENT KIT

(71) Applicant: David T. Boone, Louisville, KY (US)

(72) Inventor: David T. Boone, Louisville, KY (US)

( * ) Notice: Subject to any disclaimer, the term of this patent is extended or adjusted under 35 U.S.C. 154(b) by 0 days.

(21) Appl. No.: 15/652,520

(22) Filed: Jul. 18, 2017

(65) Prior Publication Data

US 2018/0025709 A1 Jan. 25, 2018

Related U.S. Application Data

(60) Provisional application No. 62/493,939, filed on Jul. 21, 2016.

(51) Int. Cl.
*G10D 13/02* (2006.01)

(52) U.S. Cl.
CPC ..... *G10D 13/025* (2013.01)

(58) Field of Classification Search
CPC ..... G10D 13/025
USPC ..... 84/415–417
See application file for complete search history.

(56) References Cited

U.S. PATENT DOCUMENTS 1,595,764 A 8/1926 Elliott
2,024,937 A 12/1935 Ludwig
3,757,027 A 9/1973 Morena
4,018,130 A * 4/1977 Gariepy, Sr. ..... G10D 13/025 84/415
4,095,505 A 6/1978 Hoey
4,967,634 A 11/1990 Whynott
6,091,010 A * 7/2000 Gauger ..... G10D 13/025 84/415
6,172,288 B1 1/2001 Freer
6,441,287 B1 * 8/2002 Crouch ..... G10D 13/025 84/415
6,689,944 B1 2/2004 Okumura
7,151,211 B2 * 12/2006 Whittington ..... G10D 13/022 84/415
7,223,910 B2 5/2007 Shimada
7,741,550 B2 * 6/2010 Miyajima ..... G10D 13/025 84/415
7,884,272 B2 2/2011 Abe
7,888,575 B1 2/2011 Toscano
2004/0031375 A1 2/2004 Hayden
2005/0241457 A1 11/2005 Shimada

* cited by examiner

*Primary Examiner* — Jianchun Qin

(74) *Attorney, Agent, or Firm* — Carrithers Law Office, PLLC; David W. Carrithers

(57) ABSTRACT

An adjustable drum snare kit includes a stretcher panel holding replaceable strands of beads or wire which cooperatively engage a snare drum together with a tool for adjusting the tension of the stretcher panel and snare drum strands held thereby enabling quick replacement of individual strands for repair or performance reasons.

18 Claims, 8 Drawing Sheets

ADJUSTABLE DRUM SNARE AND TENSION ADJUSTMENT KIT

CROSS REFERENCE TO RELATED APPLICATIONS

This application claims priority from U.S. Provisional Application Ser. No. 62/493,939 filed on Jul. 21, 2017 and is incorporated by reference herein in its entirety.

TECHNICAL FIELD

The present invention relates to the field of snare drums and particularly to the 'snare' or grouping of wires which are spaced from and stretched across one of the heads of the drum under tension to create a desired rattle or sound upon vibrating against the drum head surface upon striking the top head of the drum.

BACKGROUND OF THE INVENTION

The side drum is a percussion instrument characterized by a shallow cylindrical shape and powerful, staccato sound. Metal wires called snares are stretched against the bottom head to form a snare drum. Snare drums are used in a wide variety of musical venues such as orchestras, concert bands, marching bands, parades, drum lines, drum corps, and more. The snare drum is one of the central pieces in a trap set, a collection of percussion instruments designed to be played by a seated drummer, which is used in many popular genres of music. Snare drums are usually played with drum sticks, but there are other options which create a completely different sound, such as the brush.

There are many types of snare drums such as the kit snare, marching snare, tarol snare, and piccolo snare. Each type presents a different style of percussion and size. The snare drum that one might see in a concert is usually used in a back beat style to create rhythm while in marching bands, the snare drum can do the same but is used mostly for a front beat.

The snare drum comprises a hollow cylinder with two heads with one head stretched over each open end of the cylinder. The heads are both usually made of a plastic material such as MYLAR. Usually, the bottom head has a snare mechanism including metal wires called snares which are stretched against the bottom head. However, the snare mechanism can also be placed on the top, as in the tarol snare. The top head is usually called the batter head because that is the head which is struck by the drummer. The bottom head is generally called the snare head because that is where the snares are usually located. The tension of the drumhead is held constant by tension rods which may be tightened, thus providing an opportunity to alter the sound of the hit. The strainer is a lever that 'strains' or tightens the snare against the head. When the strainer is relaxed, the sound of the snare is more like that of a tom because the snares are not active. The rim is a metal ring which holds the batter head tightly, and which can be used for a variety of things such as being used to sound a piercing rim-shot with the drumstick.

Drum strainers are comprised of a plurality of spaced apart crimped wires spaced apart a selected distance from, and stretched across, the surface of the drum. When the drum vibrates it contacts the strainer and has a "crack" sound. When a strain of a drum strainer breaks the entire unit must be replaced.

The cylindrical shell of snare drums may be made from various woods, metal, or acrylic materials. A typical diameter for snare drums is around 14 in (36 cm). Marching snare drums are deeper in size than snare drums normally used for orchestral or drum kit purposes, often measuring 12 in long (that is, the length of the cylindrical shell). Orchestral and drum kit snare drum shells are about 6 in (15 cm) deep. Piccolo snare drums are even shallower with a length of about 3 in (7.6 cm).

Most snare drum shells are constructed in plies (layers) that are heat and compression molded into a cylinder. Steam-bent shells usually consist of one ply of wood that is gradually rounded into a cylinder and glued at one seam. Reinforcement hoops are often used on the inside surface of the drum to keep it perfectly round. Segment shells are made of multiple stacks of segmented wood rings and are glued together and rounded out using a lathe. Similarly, stave shells are constructed of vertically glued pieces of wood forming a cylinder (much like a barrel) that is also rounded out using a lathe. Solid shells are constructed of one solid piece of hollowed wood.

The heads include the top head referred to as the batter head and the snare (bottom or resonant) head. The snare head is usually much thinner than the batter head and is not beaten while playing. While older snare drums had heads made from calfskin, most modern drums use plastic (Mylar) skins which are around 10 mils in thickness. (One mil is one thousandth of an inch.) However, multiple plies (usually two) of around 7 mils are used for the batter head. Snare heads are usually only a few mils thick to better enable them to respond to the movement of the batter head as it is played. Pipe band requirements have led to the development of a Kevlar-based head, enabling very high tuning, thus producing a very high-pitched cracking snare sound.

As discussed in U.S. Patent Publication 2004/0031375 by Hayden, III which published on in February of 2004 and is incorporated by reference herein, conventional snare drums, such as those manufactured by Premier, Pearl, Andante, Yamaha, Ludwig and others, feature one or more snares, each of which is positioned adjacent to a bottom (snare) head as found in most drums, and/or a top (batter) head as found in drums used by marching bands. Conventional snares are formed of a plurality of wire helix or coil segments, the ends of which are commonly welded directly to a pair of strainers or end pieces. The end pieces may be mounted on a snare support mechanism, which is in turn mounted to the drum shell. Typically, the end pieces are adapted to draw the wire segments under tension in a manner that allows their tension to be adjusted by movement of the end pieces to allow adjustment of the distance between the wire segments and the drum head. Such tension and height adjustment mechanisms are conventionally employed to tune the snare to optimum performance with the head.

Tuning of a snare drum involves optimizing acoustical performance of the snare, head and shell. A compression ring which retains the drum head on the shell typically contains a number of tensioning bolts which may be turned with a wrench or key to increase or decrease tension on the drum head. When the drum head is tensioned the snare requires adjustment in order to tune the drum to produce the desired sound. The drummer adjusts the height of a conventional snare relative to the head and then adjusts the tension until the wire segments are disposed at proper height and tension to vibrate for proper acoustical effect without unwanted "buzzing."

A wire that is stretched between two posts and is plucked will vibrate and create a sound or musical note. The vibration of the wire will create a fundamental frequency, which has its nodes at the end points. The equation or formula to find the frequency of the sound as a function of the wire tension, length, diameter and density of the material, is based on the equation for sound created from a string. Changing the various parameters result in changing the frequency of the vibration and thus the sound.

The equation for the fundamental frequency of a taut wire as a function of tension, length, diameter and density of the wire material is:

$$f=(1/Ld)*\sqrt{(T/\pi\delta)}$$

where f is the frequency in hertz (Hz) or cycles per second

L is the length of the wire in centimeters (cm)

d is the diameter of the wire in cm T is the tension on the wire in gm-cm/$s^2$

π is the Greek letter pi=3.14

δ is the density of the wire in gm/$cm^3$ (Greek letter small delta)

$\sqrt{(T/\pi\delta)}$ is the square root of T divided by πδ

Tensioning a conventional wire helix snare can result in problems. When the drummer increases the tension on the segments, they elongate and thereby decrease in diameter. Additionally, when such snares are over tensioned, the wire coils may exceed their elastic limit and experience undesirable permanent deformation that causes them to sag or loosen relative to the drum head and the other snares welded to the end pieces resulting in undesirable acoustics or harmonics and in most instances, necessitating the replacement of the snare assembly. Over tensioning can also subject the wire segments to undue abuse and additional tension imposed by drum sticks contacting the head during normal playing of the drum. This is especially true for drums where a snare is positioned against the top head on the side opposite the surface on which the drum sticks hit.

Snares for snare drums which are adjustable reduce tension from the dimension and shape of snare segments comprising stands or wire under tension which contact the drum head. Snares include one or more tensioning members such as wire and a plurality of head contact members such as coils or beads. The tensioning members may be connected to conventional snare strainer plates or end pieces. Some or all of the tensioning members support or carry one or more head contact members. The tensioning members may be wire, polymeric material or other desired material. The head contact members may be wire coils or helixes, formed of beads or other periodic or non-periodic shapes or structures or structured and configured as otherwise desired to be carried on tension members and cooperate effectively with the drum head for proper acoustical effect. The snares are adapted to be used with batter and bottom heads.

U.S. Pat. No. 4,095,505 by Hoey et al. and incorporated herein by reference describes a snare for a drum composed of molded plastic cords having integrally molded enlargement of nodules evenly spaced along the tension strand attached to metal of plastic end pieces mounted onto the drum.

SUMMARY OF THE INVENTION

The four variables that affect the sound from a snare drum are the tension of the playing surface (batter head), the tension of the snare head (bottom head), the tension of the snare strands or tension members, and pressure of the snare strands or tension members against the snare head.

Conventional snares are comprised of spring steel strands that have been stretched to maximum tension and then soldered to a base plate on each end. Tightening or further stretching of the snare wires produces no discernible change in the sound. The instant invention allows the player to adjust both tension of the strands and pressure of the strands against the snare head making it possible to find the "sweet spot" of the snare drum sound. The instant invention allows the tension of the snare stands to be tuned as loose or as tight as the player desires as opposed to conventional snare systems. The instant invention gives the player the ability to adjust the snare sound by adjusting the variables affecting the sound of the snare drum.

For example, a tight batter head with a loose bottom head with the snares set at minimum tension will produce snare sound with a fuller snare sound. A tight batter head with a tight bottom head along with a tight snare strand produces a quick and shorter snare sound such as those found in march drums. The present invention allows for adjustment of snare strand tension selected by the player for a particular sound allowing for an infinite number of snare sounds. The use of beads or other snare members disposed on the snare strands or segments composed of materials having selected physical structure or composition provides even more of a variety of snare sounds.

The present invention describes an apparatus and method to remove and/or replace individual snares or wires from the snare strand or changing the shape or density, or size of the snare members by substituting particular strands with a different material providing an opportunity to customize the snare drum and the sound produced therefrom due to the number, shape, composition, and selected combination of snare material for snare tensioning based on the shape of head contact members such as the size, shape, and/or composition of beads strung on a strand. Tuning is made easier and undesired deformation of the snares from over tensioning or other causes is reduced or eliminated.

The drum snare of the present invention include a plurality of tension members such as wires and a head contact member such as coils, beads or other members strung on the tension members to produce a desired sound characteristic and a method of holding the tension members allowing quick and easy replacement, substitution, replacement, removal, or addition of tension members having selected contact members for particular applications. Moreover, the elasticity or ductile strength of the selected strands may vary even while the tension remains constant with respect to the snare tension members so that the lateral forces remain consistent over the width of the snare and attachment point to the drum. The sound from individual contact members may differ depending upon the contact member composition, physical size, chemistry, or structure even though the tension member tension remains constant. Of course, tension members having a different tension may also be used on the same snare. Devices such as spacers or bars having a particular shape such as a wedge or conical shape may also be used to vary the tension of the selected tension members.

As a result, the snare segments that span the end pieces may be installed having the same tension or the characteristics of the contact members may be used to determine the effect of the snare segments on the drum head. The tension members which may be straight, helix, or coiled, to provide a greater elastic constant for improved tuning of the drum.

Each snare segment comprising a wire is formed by a tension member or part of a tension member which is adapted to be laced on or otherwise retained under tension by the bracket or strainer plate end pieces of the snare. A plurality of head contact members, which may be wire coil or helixes, may be threaded on or otherwise disposed on the tension member or members. Alternatively, a plurality of beads may be threaded or otherwise disposed on the tension members. Any other desired shape, density, or composition of contact member may be suspended or supported by the tension member or tension members as desired. When the height of the snare relative to the drum head has been adjusted, tensioning of the snare may be accomplished without any further effect on height of the head contact members relative to the drum head or deformation due to the application of tension forces. Accordingly, tuning is made easier and any potential for permanent deformation is reduced or eliminated.

The present invention comprises a drum snare kit including a drum snare or strainer which has replaceable strands of wires (strand members) and (contact members) held in cooperative engagement with a drum surface together with a loadable rack apparatus for releasably flexing, comprising and holding a stretcher panel for releasing the tension of the strand members which are releasably held by spaced apart slots or teeth formed along the width of the distal ends of the stretcher panel which takes the place of an strainer plate or bracket for holding and mounting the snare on the drum and controlling the tension of the strands during replacement thereof. Openings or apertures are formed at selected locations in the stretcher panel for cooperatively engaging holding members such as hooks extending from straps which are inserted into a conventional tension adjustment mechanism extending from the rim or edge of the drum and fastened to the drum body.

Each strain could be comprised of crimped wire or each strain may contain a plurality of beads various sizes, densities or composition alone or in combination with crimped wire strainers or a ball chain depending upon the sound characteristic desired by the user.

The different types of beads on different strains produce a selected different sound. A novel feature of the invention compared to conventional snares is that individual wires defining snare segment or snare members and/or the contact members can be replaced by the user. The snare members can be spaced apart, the tension adjusted on selected snare members, or the number of snare members can be varied to product a particular sound. It is contemplated that means for varying the tension such as a bolt or dial extending therefrom threadably engaging a holding member or bracket can be rotated to increase the tension on the strap retaining the snare stretcher pane to hold it into position. The dial or other adjustable means may be used to vary the height from the drum as well such as is shown and described in FIG. 2 of U.S. Pat. No. 4,967,634 by Whynott and incorporated be reference herein.

A spacer means such as a longitudinal member may be inserted between the drum rim and snare wires or between the drum surface and snare wires to vary the tension of the wires, dampen the vibration or to provide other sound changing features. The strains may be wrapped around individual disc or pulleys rotatably mounted on an axle or spindle held normal to the strains so that removal of the spindle allows removal of a selected individual pulley.

In accordance with the present invention, there is provided a snare system for a snare drum comprising, consisting of, or consisting essentially of a snare mechanism and a tool for removing and or replacing individual snares or beaded strands. The snare mechanism includes a longitudinal stretcher panel and a plurality of beaded strands. The stretcher panel is generally flat with a Z-shaped form at each longitudinal end having a downward 90 degree bend at about three-eighths to one-half inch from a free end of the panel, and an outward 90 degree bend at about three-sixteenths to one-quarter inch from a free end of the panel. Each of the free ends of the panel has a plurality of outward extending open slots. The panel has a first aperture formed in a center thereof and has two second apertures formed along a longitudinal centerline thereof about one inch from each free end of the panel. The two second apertures are capable of receiving and holding hooks fixed to the end of snare mechanism holding belts.

Each strand of beads comprise a wire including a plurality of beads having holes therein immovably affixed adjacent one another. Each end of individual stranded beads is inserted at one end and the other end of a loadable rack having a means for adjusting the tension of the strands with a pre-tensioned stretcher panel. The strand of beads are stretched tightly by the stretcher panel which comprises a material such as spring steel or other metal of polymer that is flexible and has memory. Each end of the panel is secured to and abuts against stops members of the rack. The drum snare kit also includes a stretcher compression tool such as a loadable rack for enabling the removal and or replacement of individual strands of beads. The loadable rack includes a first longitudinal block having a longitudinal valley. The first longitudinal block has a transverse threaded downward extending aperture formed therein in the center and a concave surface extending from one of the longitudinal to the other end or at least a selected distance along the longitudinal block.

The loadable rack has a second longitudinal block including a downward extending convex shape which conforms in shape with the longitudinal valley of the first longitudinal block. The second block has a transverse downward extending aperture formed in the center. The tool further includes a clamping screw passing through a flat washer, through the transverse downward extending aperture formed in the second longitudinal block, and finally into the transverse threaded downward extending aperture formed in the first longitudinal block. The clamping screw includes a removable wing nut. The tool is capable of receiving the stretcher panel between the longitudinal valley and the downward extending convex shape and upon tightening the clamping screw, is capable of flexing the stretcher panel, thus loosening the strands of beads.

It is an object of this invention to provide a snare system for a snare drum having strands of beads stretched tightly from one end of a stretcher to the other end.

It is an object of this invention to provide a snare system for a snare drum wherein the stretcher is a panel made of resilient material with spaced apart slots on each end for receiving and holding the strands of beads which are stretched across the panel from end to end.

It is an object of this invention to provide a snare system for a snare drum wherein an individual snare strand may be easily replaced when desired or necessary, thus removing the need of replacing the entire snare.

It is an object of this invention to provide a snare system for a snare drum wherein the center of the stretcher may be pressed into the valley of a U-shaped tool, causing the stretcher to be deformed, thus allowing bead strands to be individually removed, added or replaced.

It is an object of this invention to provide a snare for a snare drum wherein the stretcher includes straps for mounting the snare to a standard snare drum containing a cleat on one side of the drum shell and a strain lever with another cleat on the other side of the drum shell.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
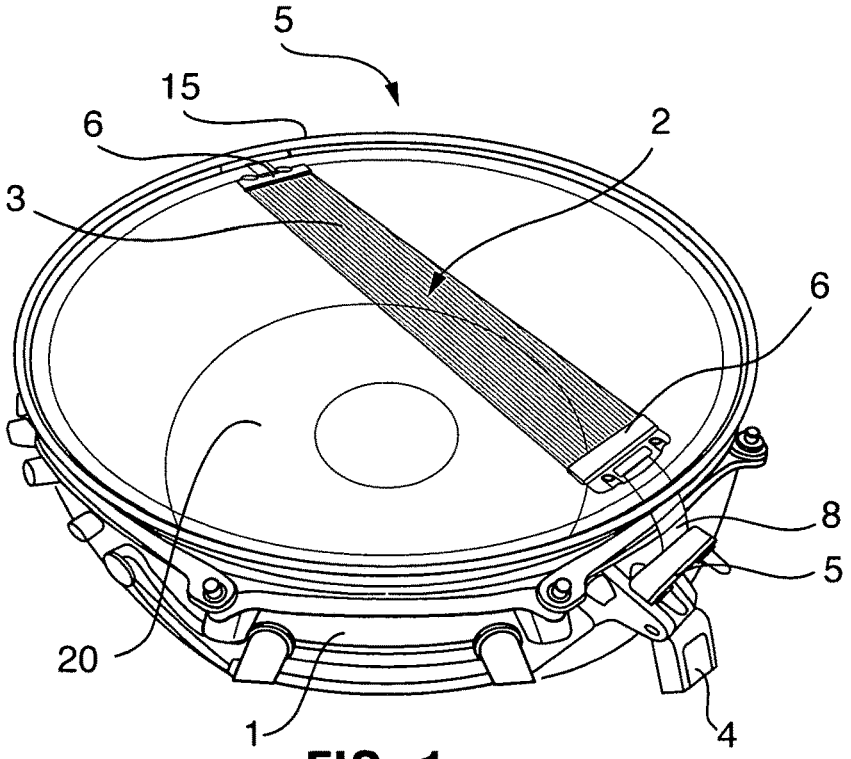
FIG. 1 PRIOR ART
FIG. 1 shows a conventional snare assembly with coil strands mounting to a drum.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As used herein, the term "about" can be reasonably appreciated by a person skilled in the art to denote somewhat above or somewhat below the stated numerical value, to within a range of ±10%.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 2:
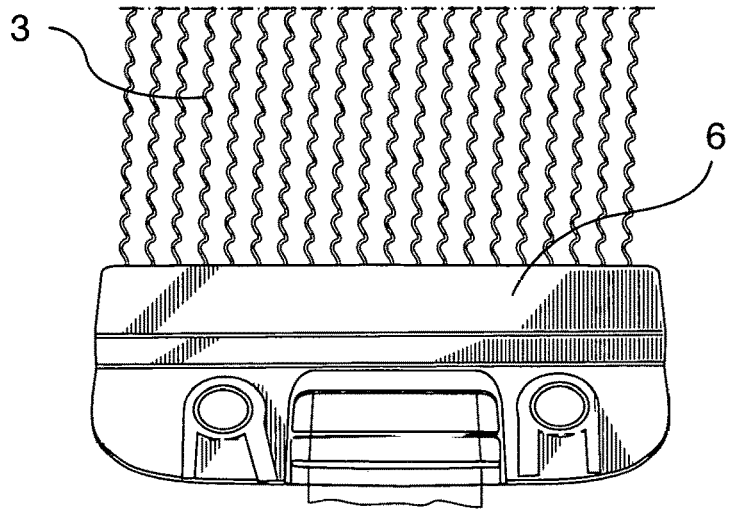
FIG. 2 PRIOR ART
FIG. 2 shows conventional crimped or spiral wires permanently fastened by weld or other means to a brackets for attachment to a drum head.
Figure 3:
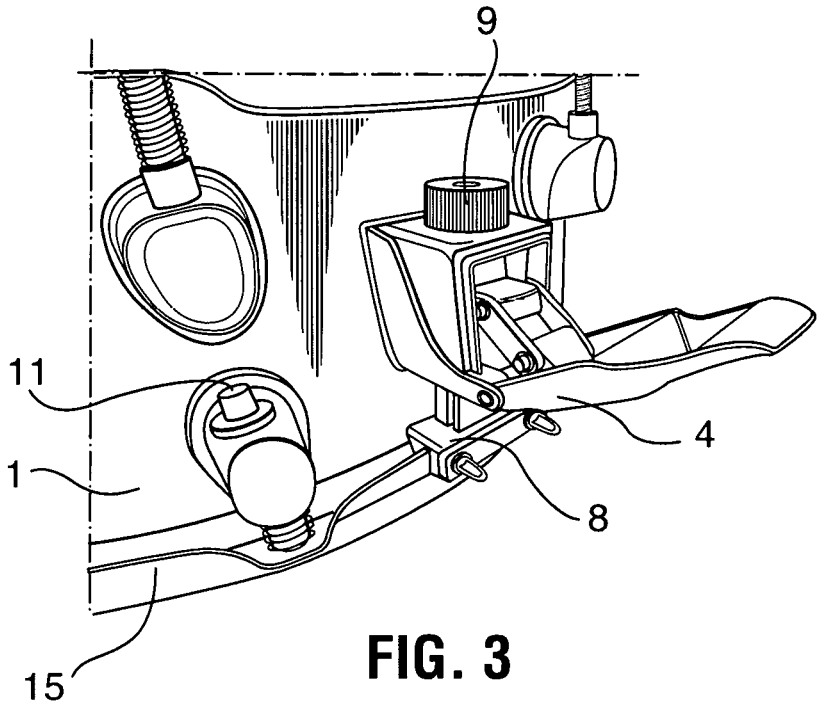
FIG. 3 shows an adjustable holding means having a rotatable knob for adjusting the tension of a strap holding the snare or strainer to the drum head.
Figure 4:
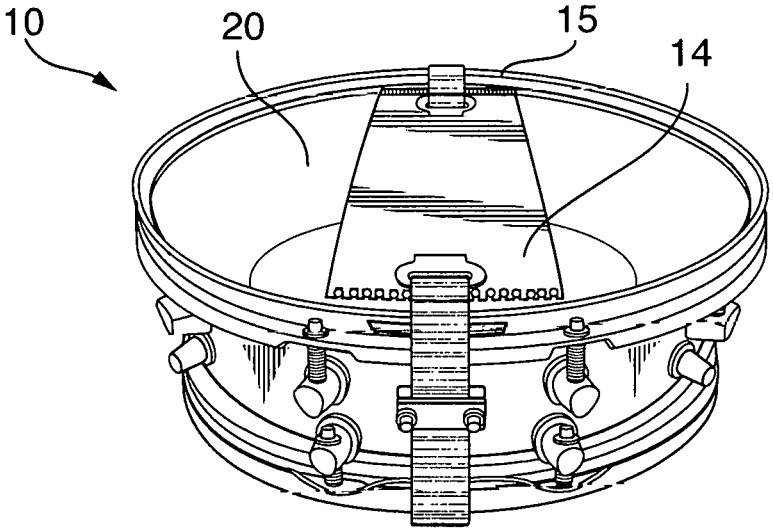
FIG. 4 is an end view showing a snare of the present invention held in position by a hook extending from a strap affixed to a strap retainer, loop, or cleat mounting to a drum.

In accordance with the present invention, there is provided a snare system for use on a snare drum. Prior art FIGS. 1-2 show the bottom of a typical snare drum 5 including an outer cylindrical shell 1 with a snare head 20 stretched across the opening by pulling the bottom rim 15 tight using the tightening screws 11.

The prior art snare 2 comprises at least one strand segment and preferably a plurality of tension strands or tension strand segments located adjacent the drum head. The prior art tension strands 3 may include a plurality of crimped wires or segments composed of wires comprised of metal such as aluminum, steel, stainless, steel, copper, and other metals; polymers such as nylon or high density polymers; graphite composite materials; and combinations thereof. As set forth in U.S. Pat. No. 3,757,027 by Morena et al. incorporated by reference herein, the tension strand or segment may comprise an outer helically wound wrap extending between the ends thereof. The cross section of the core may be rectangular (having a square cross-section), round and polygonal. The metal outer wrap may be plated or unplated. The wrapping may be wound onto the core under such tension that it will not slide along the core by itself but can be slid off. The winding may be secured at either one or both ends of the core. The diameter or maximum transverse dimension of the core member is preferably between 0.010 inches and 0.250 inches while the transverse dimension or diameter of the material used for the outer wrap is preferably between 0.010 inches and 0.125 inches. The pitch between adjacent turns of the helically wound outer wrap is preferably between 0.010 inches and 0.250 inches. The tension strand may comprise at least one elongated core adapted to be secured to the snare drum butt plate at one end and to the throw off bridge tension plate at the other end. The tension strand may be provided with a helical outer wrap, a metallic core with a non-metallic outer wrap, a metallic core with a metallic outer wrap, a non-metallic core with a metallic outer wrap and a non-metallic core with a non-metallic outer wrap. The core may be a steel piano wire, a nylon, a polyacetal, a dacron, a gut, a silk fiber, or combinations thereof. The outer wrap may be a copper, a brass, a tin, a nylon, a graphite material, a stainless steel, a steel, an aluminum, a graphite material, a gut, and combinations thereof. The outer wrap may include tension contact members which are cylindrical, spherical, or other selected shape. The tension strand may be a single wire or strand or may be a plurality of small strains braided together. The helical outer wrap may be secured to the core at either or both ends or may not be secured at all to the core.

Means of attaching the snare tension strands to drum may vary widely without departing from the invention. For example, conventional snares include two opposing end pieces or brackets 6 as shown in FIG. 1 with one bracket 6 attached to a distal end of a conventional strainer by welding or a compression fit. A strap or belt 8 and the opposing bracket 6 attaching to a conventional butt or cleat attached to the drum shell diametrically opposite from the strainer. The crimped or spiral wires of conventional snares are permanently fastened by weld or other means at their distal ends to the brackets 6 and are therefore, not individually replaceable. A first bracket 6 has a belt 8 for attachment to a snare drum cleats 5 one on each side of the snare drum shell 1. The other opposing belt 8 is attached to the snare drum shell by an adjustable holding means such as a snare strainer lever 4 which also includes a tension setting knob or lever 9. A typical holding means is described in U.S. Pat. No. 4,967,634 by Whynott which is incorporated herein. U.S. Patent Publication 20050241457 by Shimada describes an alternate holding means for positioning and holding the snare in position on the drum under tension. The snare and tension strands are adjusted in height with respect to the drum head to obtain the desired acoustics. The contact members typically rest against the surface of the head of the drum. The more strands the more "crack" results from activation of the snare. Beads of different sizes may be used on the same or different tension strands of the same snare. More of a tinning sound is associated with smaller beads as opposed to larger or heavier beads developing a muffled sound.

As shown in the figures, the stretcher member 14 comprises a generally flat longitudinal strip of material stiff enough to support the tension strands or segments affixed thereto by at each end under a selected amount of tension extending along the longitudinal axis. The stretcher member 14 is comprised of a resilient material having "memory" such as a fiberglass, a metal such as aluminum, galvanized steel, anodized steel, brushed steel, copper or a metal alloy such as stainless steel or brass, a carbon fiber or graphite material, or a polymer such as polycarbonate or other high impact polymer such as LEXAN or PLEXIGLAS, a mirrored plastic or metal. For example, one embodiment is between 0.025 to 0.100 inches thick and is preferably made of stainless or spring steel. A central aperture measuring between one eighth and three eighths inch in diameter is formed at approximately the center of the longitudinal stretcher member 14. Additional apertures may be formed in the surface for aesthetic reasons or the shape of the stretcher panel 14 may vary as a design or ornamental feature or include apertures to reduce weight.

The longitudinal stretcher 14 of the present invention, as shown in FIGS. 4-9, 11, 13-15, and 17-18, includes a thin longitudinal strip of material with a plurality of spaced apart teeth 30 at each end forming slots 24 there between. The tension strand 16 includes at least contact member such as a bead 16 coaxially mounted onto a tension strand wire segment 31 disposed in the slot 24 between the teeth 30 whereby the slot is of a wider width than the wire segment 31 and a narrower width than the bead 16 in order to hold the tension strand 16 in position. Other tension strand holding means may include a irregular detent, a groove, a knob, a knot or a projection at or near the distal end of a tension strand or segment member to be mounted thereon. As shown, a chain having a plurality of balls threaded onto an immovably fixed in position about a center wire of is removably held between teeth of about three-eighths to one-half of an inch in length. The teeth are bent or angled downward with respect to the longitudinal stretcher member surface at a selected angle as for example a 90 degree angle. The distal end of the teeth extend about three-sixteenths to one-quarter of an inch from the end of the stretcher 14 are then bent outwardly at another selected angle of about 90 degrees to extend outward generally parallel to the longitudinal stretcher member 14.

The slot 24 between the teeth 30 receive the end of an individual tension strand or segment 16 or enlarged contact member such as a bead affixed to the tension strand 16. The slots 24 are shown as having a rectangular configuration; however, it is contemplated that a arcuate or angles slot can be used therefor. As shown in the FIG. 9, one end of a strand of beads 16 is inserted in a selected slot 24 on a first end and the other end of the strand of beads 16 is inserted in a corresponding slot 24 of the opposing end of the stretcher member 14. The strands of beads are stretcher tight enough to maintain a curved or bowed configuration so that the normally flat stretcher panel 14 is caused to bow slightly away from the tension strands. This keeps the beaded tension strands 16 of the snare stretched tightly.

The stretcher member or stretcher panel 14 as shown in the figures must provide a generally stiff and resilient material having at least some flexibility and memory in order to keep the tension strands taut. Materials such as a fiberglass, a metal (a copper, a spring steel, a stainless steel, an aluminum, a metal alloy such as brass), a graphite material, a carbon fiber, a polymer, and combinations thereof.

The stretcher panel 14 includes at least one attachment means in close proximity to each end, as for example a pair of rectangular apertures 31 spaced apart in an alignment with one another located along the longitudinal centerline, each aperture formed at a selected location near the distal ends of the stretcher panel 14. It should be noted that contrary to conventional snares which typically include tension strands affixed to brackets which are pulled from their distal ends to the edge of the drum rim, the tension on the brackets held to the drum do not control the tension on the snare's tension strand. In the present invention, the tension on the tension strands is independent of the drum holding straps and is determined by the tension placed on the tension strands 16 by the spring of the stretcher member 14 as adjusted by a rack. The stretcher member 14 includes at least one aperture 32 such as a rectangular slot near each end of the stretcher member 14 positioned within about an inch of the opposing ends of the panel 14.

Figure 5:
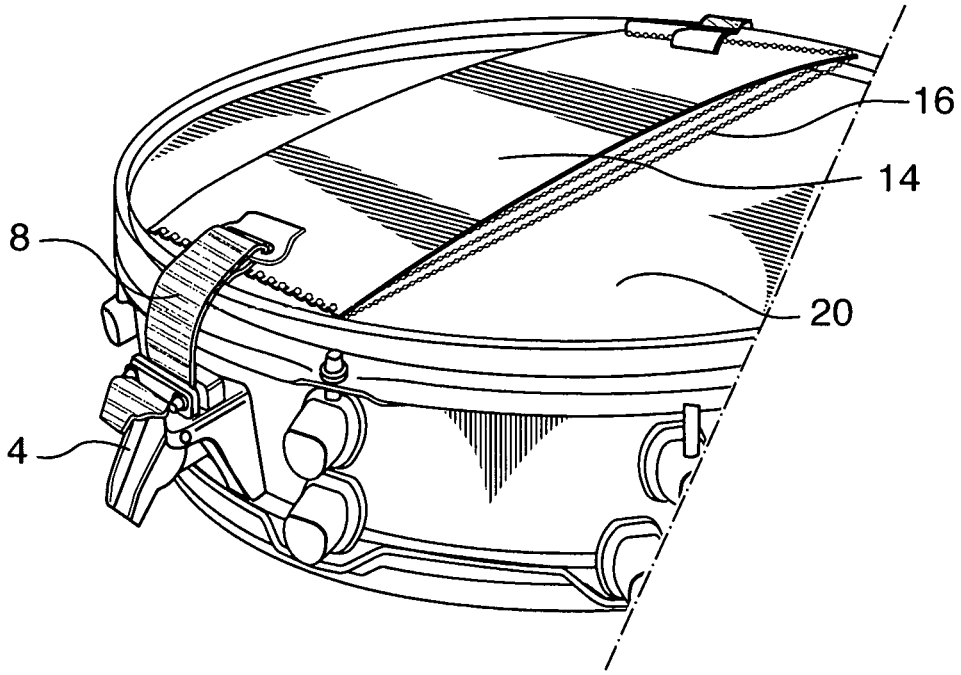
FIG. 5 is a perspective view of the adjustable snare attachment mechanism holding a strap extending to a stretcher panel extending across the drum surface and curved upward supporting the tension strands of the snare between its distal ends.
Figure 6:
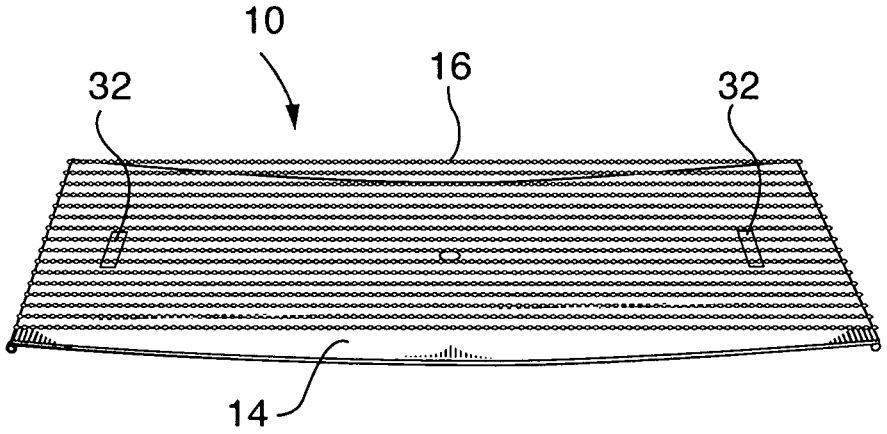
FIG. 6 is a perspective inverted view of the stretcher panel under tension showing a plurality of tension strands or segments removably held at a selected tension between the slotted distal end edges and extending across the width of the stretcher panel wherein the stretcher panel end edges curve downward.
Figure 7:
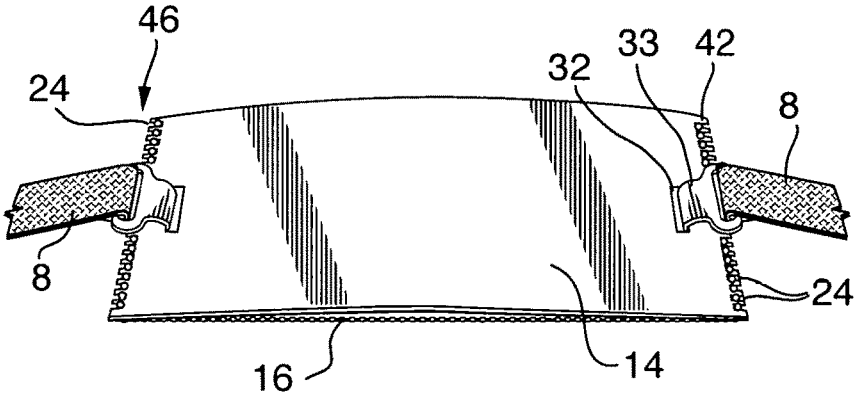
FIG. 7 is a perspective view of the top of the snare mechanism showing the two tension belts hooked into the apertures near the ends of the stretcher panel extending over the slotted end edges.
Figure 8:
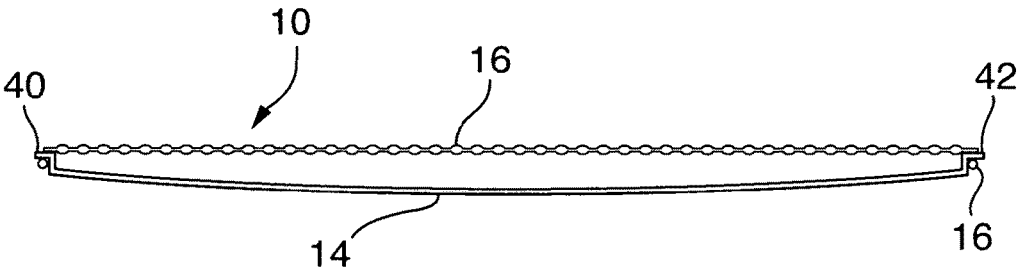
FIG. 8 is side view of the snare mechanism of the present invention showing the stretcher panel and tension strands held between the distal end edges with the stretcher forming a curve along its longitudinal length directed away from the tension strands.

Alternate embodiments of the present invention have two apertures 32 which are round, square, oval or any shape capable of holding a selected hook 33 or the panel may include a projection such as a knob, cleat, loop, for cooperatively engaging the hook 33. A belt or strap 8 having an attachment means such as a hook 33 cooperatively engages apertures 32 on or near each end of the panel. The tension strands are held against or spaced apart from the surface of the drum 20. The free ends of the belts 8 are clamped into a cleat 5 on one side of the drum and the opposing end of the belt 8 is held by a tension adjustment mechanism means, as shown in FIG. 5. A strainer lever 4 on the drum is then pushed to a tightening position for holding the snare mechanism tight against or slightly spaced apart from the bottom head surface 20.

Figure 9:
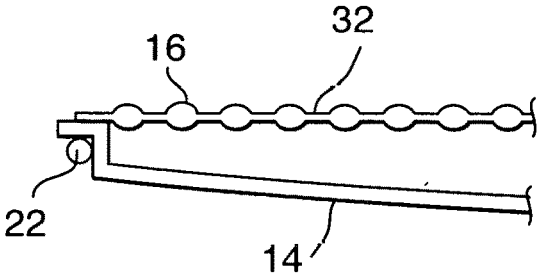
FIG. 9 is an enlarged view of a tension strand containing ball contact members mounted onto a wire forming a chain whereby a ball link is disposed in a selected slot between adjacent teeth extending along the slotted end edge close end view of one end of the snare mechanism.
Figure 10:
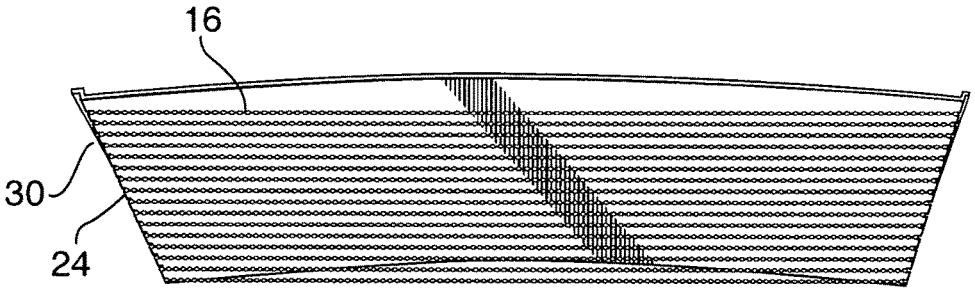
FIG. 10 is perspective view of the stretcher panel under tension showing a plurality of tension strands or segments removably held at a selected tension between in slots formed on the opposing slotted distal end edges and extending across the width of the stretcher panel wherein the stretcher panel end edges curve upward.
Figure 11:
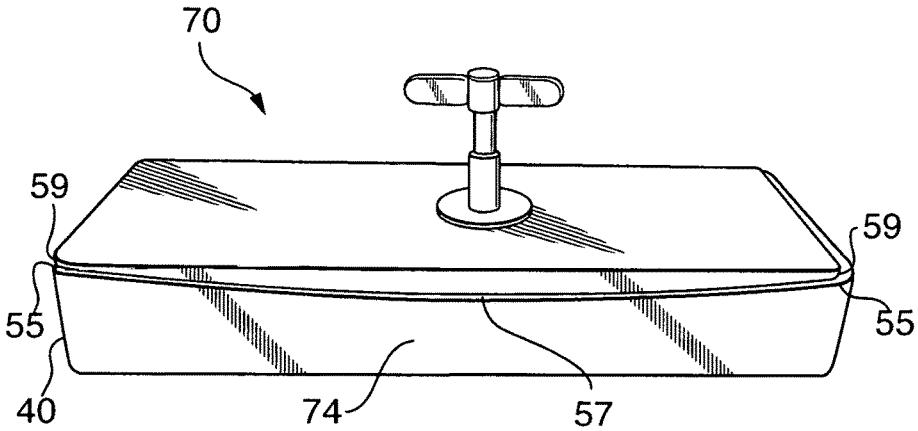
FIG. 11 shows a rack assembly kit for exerting pressure on the mid section of the stretcher while supporting the ends in order to decrease the tension on the tension strands by shortening the distance between the slotted end edges for attaching or removing strands.

FIG. 9 shows a tension strand containing ball contact members mounted onto a wire forming a chain whereby a bead is disposed in a selected slot between adjacent teeth extending along the slotted end edge close end view of one end of the snare mechanism. The assembled snare 10 is shown in FIG. 10 whereby the stretcher panel 14 under tension shows a plurality of tension strands 14 removably held at a selected tension by segments 32 disposed between slots 24 formed on the opposing slotted distal end edges 40, 42 and extending across the width of the stretcher panel 14 wherein the stretcher panel end edges 40, 42 curve upward.

A rack assembly tool kit 70 is used to install, replace, or remove individual tension strands 16 from the stretcher 14 of the snare mechanism 10 as best illustrated in FIGS. 11-17. The rack assembly tool kit 70 includes a first longitudinal block or rack 40 which includes a longitudinal valley defining a concave surface extending from one end to the other with the center section 72 having a narrower height and is less thick than the ends 74 of the rack 40 which includes a with a transverse bore 50 with a threaded retaining member 52 disposed in the transverse bore.

Figure 12:
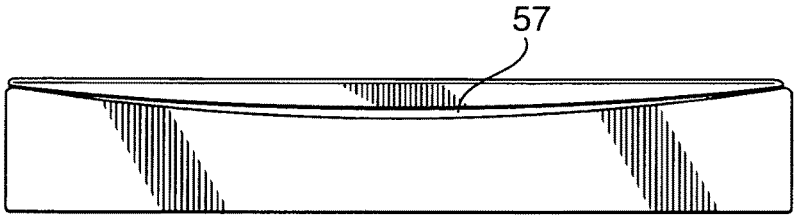
FIG. 12 is a side view of the rack assembly of FIG. 12.

A second longitudinal block defining a pressure plate 44 includes a bottom surface having a downward extending convex shape which generally conforms with the top surface or valley 53 of the first longitudinal rack 40. The pressure plate and rack can be fabricated from wood, plastic, metal, fiberglass, or other synthetic material and can include apertures of be designed as a framed member so long as the structural relationship is maintained. The pressure plate 44 includes a thicker center section having a central throughbore 51. A clamping mechanism or clamp compression tool 45 includes longitudinal threaded member or screw 46 passing through a flat washer 47 resting on the top surface 49 through the central throughbore 51 in the pressure plate 44, and into the transverse aperture 50 in the rack 40 to threadably engage screw 46. A holding means such as a nut or removable wing nut 48 is used to rotate and cooperatively engages the screw which compresses the bottom surface 60 of the pressure plate 44 against the top surface 53 of the rack 40. An important feature of the rack assembly kit is that when the pressure plate 44 rests on the rack 40, the distal end edges 55 of the rack 40 support the distal end edges 59 of the pressure plate 44 above the valley 53 of the rack so that a gap 57 is formed there between in the central portion or valley 53 of the rack 40 and pressure plate 44. The gap 57 is widest at the central portion and narrows as near the ends of the rack 40 and pressure plate 44 as shown in FIG. 12.

Figure 15:
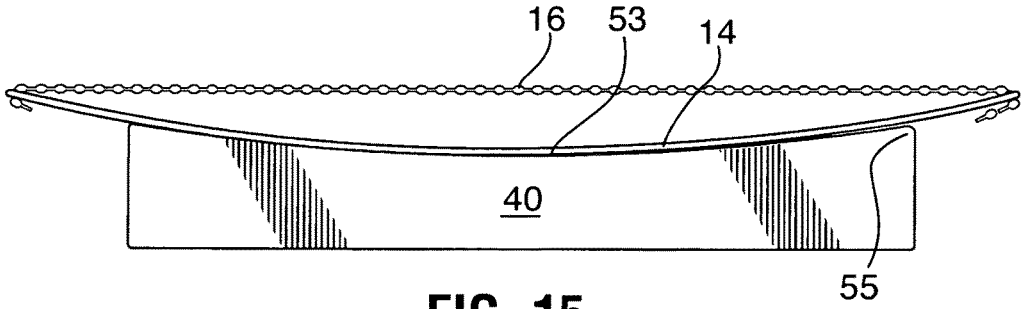
FIG. 15 is a side view of the rack assembly, stretcher, and tension strands showing the slotted end edges of the stretcher resting on the top surface of the ends of the rack and a space between the center portion of the stretcher and the center portion of the rack with tension strands strung thereon.
Figure 16:
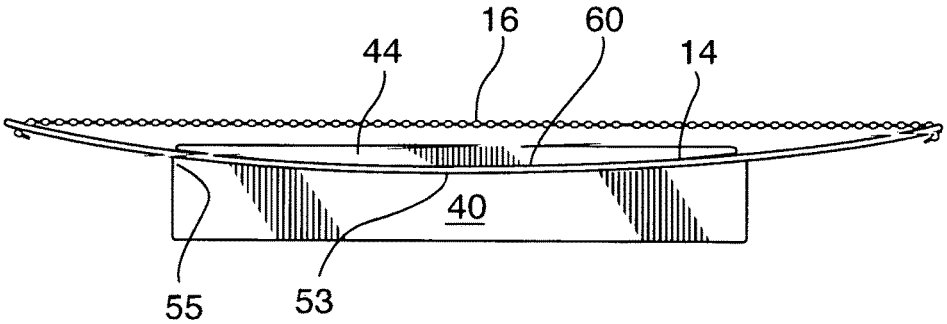
FIG. 16 shows compression of the pressure plate on the stretcher when the compression tool engages the rack deflecting the center of the stretcher downward toward the rack concave portion of the rack loosening the tension of the tension strings.
Figure 13:
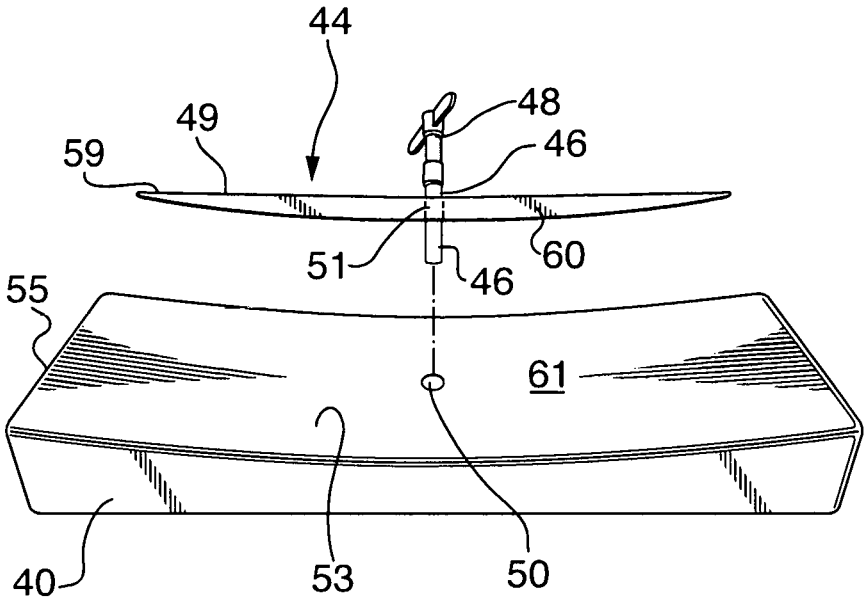
FIG. 13 shows a strand stringer rack assembly including the rack, stretcher pressure plate and clamp compression tool comprising a threaded member anchored normal to the surface of the rack.
Figure 14:
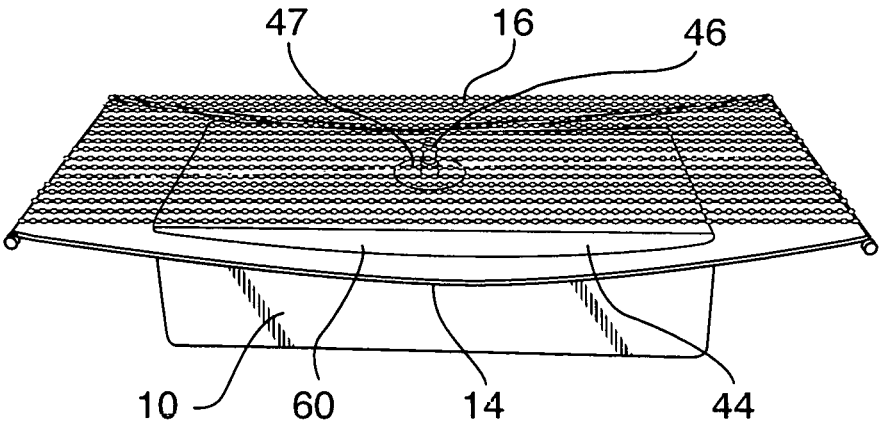
FIG. 14 shows the snare with the stretcher supported on the upper end edges of the rack and the pressure plate positioned over the stretcher in alignment with the rack and the threaded member of the compression tool extending upward from the rack through an aperture in the stretcher and an aperture in the pressure plate for cooperative threaded engagement with a holding means such as a nut or wingnut and a plurality of strands extending between the slotted end edges of the stretcher.

FIGS. 13-15 shows a strand stringer rack assembly including the rack, stretcher pressure plate and clamp compression tool comprising a threaded member anchored normal to the surface of the rack. The stretcher is inserted between the rack and pressure place and supported on the upper end edges of the rack and the pressure plate is positioned over the stretcher in alignment with the rack. The threaded member of the compression tool extending upward from the rack through the transverse bore in the stretcher and through bore in the pressure plate for cooperative threaded engagement with a holding means such as a nut or wingnut with a plurality of strands extending between the slotted end edges of the stretcher. The rack assembly, stretcher, and tension strands are shown with the slotted end edges 42, 44 of the stretcher resting on the top surface 61 at the ends 55 of the rack 40 leaving a space between the top center portion 53 of the stretcher and the bottom center portion 60 of the rack with tension strands strung thereon. The stretcher panel 14 is held between the first and the second longitudinal blocks 40 and 44. The screw 46 is inserted through the apertures in the two blocks and is threaded into the first block 40. The removable wingnut 48 is installed onto the screw 46. The screw 46 is then tightened, causing the stretcher panel 14 to flex into a more curved shape resulting in slack in the tension strands 16. Any selected strand may be installed, or removed from its slots independently so that a replacement strand may be installed.

Figure 17:
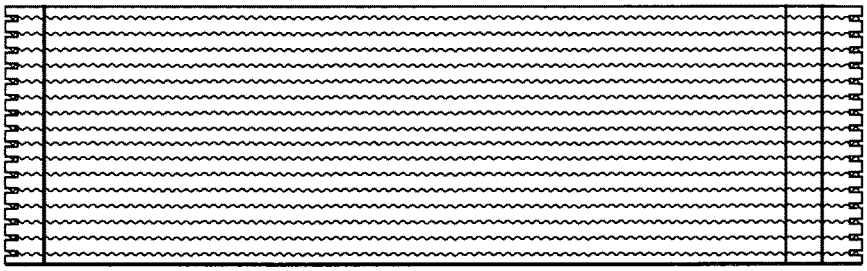
FIG. 17 shows the present invention wherein the stretcher comprises a transparent material such as glass or polymer.
Figure 18:
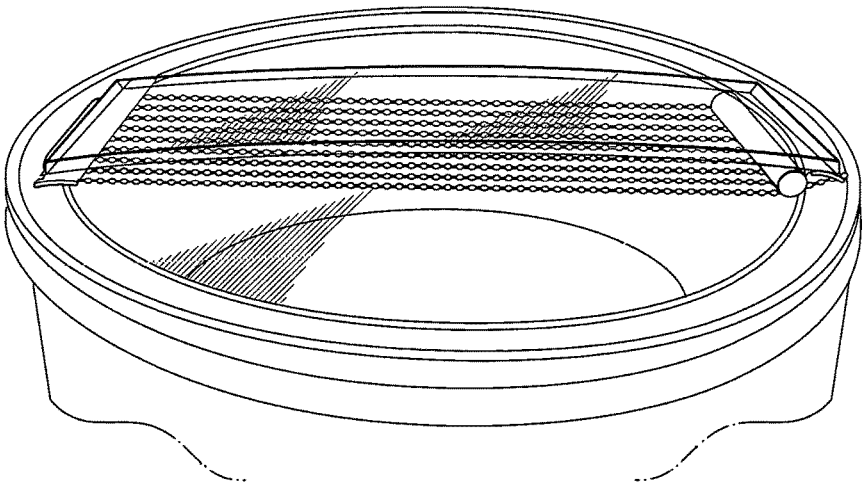
FIG. 18 shows a snare mounted to a drum whereby tension strands extend between the slotted end edges of a transparent stretcher and means for adjusting the tension includes a removable and adjustable spacer member disposed between the drum surface and the tension strands.

As shown in FIG. 17-18 the stretcher comprises a transparent material such as glass or polymer. The snare is mounted to a drum whereby tension strands extend between the slotted end edges of a transparent stretcher and means for adjusting the tension includes a removable and adjustable spacer member 90 disposed between the drum surface and the tension strands 14. The spacer member 90 may be of any size of shape which fits between the snare tension strands and drum head surface and is capable of adjusting the collection or individual tension strands of the snare. Moreover, the composition of the spacer member, whether a hard wood, metal, or plastic composition affects the performance of the snare. The spacer may be formed of at least in part of a very soft pliable rubber or elastomeric material so that contact members such as beads of a selected size or shape may be cushioned more than others to affect the sound as well.

Procedure

First, the rack is placed on the loading tool as shown in the figures with the curved concave portion facing up in a complimentary orientation with respect to the rack loading tool. The bottom distal ends of the rack are supported by the rack loading tool and a gap exists between the center of the rack and the center of the rack loading tool. Place the pressure plate onto the rack with the concave portion facing upward in complimentary orientation with the rack loading tool. By cooperatively engaging a screw and nut mechanism the extending transversely through the center of the rack loading tool, rack, and pressure plate, downward pressure on the center of the pressure place depresses or bows the rack downward in the center forming a slight downward curvature in the center portion of the rack between the rack ends resulting in a shortened distance between the rack ends creating slack in the tension members which can then be removed from or inserted onto a selected distal slot of the rack. For example, a beaded tension member can simply insert the narrow portion of the tension member between the beads into the slot(s). The process can be repeated on the opposing end of the rack. Upon insertion of the desired tension members into the slots of the rack, the pressure on the pressure place is released allowing the rack to spring back into a straight configuration and placing a desired amount of tension on the tension members stretched between the opposing rack slots.

The tension of the strands or tension members is increased by increasing the curvature of the rack while loading and shortening the length of the strands. Too much curvature of the rack may cause the strand to break and too much tension results in less vibration of the bead strands and result in a less desirable snare sound.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

I claim:

1. A snare system for a snare drum comprising:

a snare mechanism including a longitudinal stretcher panel and a plurality of stranded beads, said stretcher panel being generally flat with a Z-shaped form at each longitudinal end, said Z-shaped forms having a downward 90 degree bend at about three-eighths to one-half inch from a free end of said panel, and an outward 90 degree bend at about three-sixteenths to one- quarter inch from a free end of said panel, each of said free ends of said panel having a plurality of outward extending open slots, said panel having a first aperture formed in a center thereof, said panel having two second apertures formed therein along a longitudinal centerline thereof, each of said two second apertures being about one inch from a free end of said panel, said two second apertures capable of receiving and holding hooks fixed to the end of snare mechanism holding belts, each end of individual stranded beads inserted at one end and the other end of said stretcher panel and stretched tightly by said stretcher panel; and a tool enabling the removal and or replacement of individual strands of beads, said tool including a first longitudinal block having a longitudinal valley, said first longitudinal block having a transverse threaded downward extending aperture formed therein in a center thereof, said tool having a second longitudinal block including a downward extending convex shape which conforms in shape with said longitudinal valley of said first longitudinal block, said second block having a transverse downward extending aperture formed in a center thereof, said tool further including a clamping screw passing through a flat washer, through said transverse downward extending aperture formed in said second longitudinal block, and finally into said transverse threaded downward extending aperture formed in said first longitudinal block, said clamping screw including a removable wing nut, said tool capable of receiving said stretcher panel between said longitudinal valley and said downward extending convex shape and upon tightening said clamping screw, is capable of flexing said stretcher panel thus loosening said strands of beads.

2. A snare system for a snare drum comprising a snare mechanism comprising a longitudinal stretcher panel composed of a resilient material having memory and a plurality of aligned and spaced apart tension members having opposing distal ends extending between and adjustably attaching to a first and second distal end of said longitudinal stretcher panel by tension member holding means, at least one of said tension members including a at least one head contact member affixed thereto, said stretcher panel including a pair of opposing stretcher panel attachment means each one removably engaging a bracket extending from a strap attaching to a retaining member of a drum shell diametrically opposite from a strainer, said tension members are stretched tight enough to maintain a curved or bowed configuration to said stretcher panel cashing said stretcher panel to bow slightly away from said tension members; and a stretcher compression tool comprising a loadable rack for enabling the removal and replacement of individual strands of beads, said loadable rack comprising: a first longitudinal block having a longitudinal valley and a transverse thread downward extending aperture formed therein in the center and said longitudinal valley including a concave surface extending from one of end of said first longitudinal block to an opposing end of said longitudinal block; and a second longitudinal block including a downward extending convex member conforming in shape with said longitudinal valley of the first longitudinal block, said second longitudinal block including a transverse downward extending aperture formed in a center portion; a clamping screw passing through a flat washer and through said transverse downward extending aperture for cooperatively engaging a transverse threaded downward extending aperture formed in said first longitudinal block and a removable adjustable wing nut; said loadable rack receiving said stretcher panel between said longitudinal valley of said first longitudinal block and said downward extending convex member upon tightening said clamping screw for flexing said stretcher panel and thus loosening said tension members.

3. The snare system for a snare drum of claim 2, further including:

a tool enabling the removal and or replacement of individual strands of beads, said tool including a first longitudinal block having a longitudinal valley, said first longitudinal block having a transverse threaded downward extending aperture formed therein in a center thereof, said tool having a second longitudinal block including a downward extending convex shape which conforms in shape with said longitudinal valley of said first longitudinal block, said second block having a transverse downward extending aperture formed in a center thereof, said tool further including a clamping screw passing through a flat washer, through said transverse downward extending aperture formed in said second longitudinal block, and finally into said transverse threaded downward extending aperture formed in said first longitudinal block, said clamping screw including a removable wing nut, said tool capable of receiving said stretcher panel between said longitudinal valley and said downward extending convex shape and upon tightening said clamping screw, is capable of flexing said stretcher panel thus loosening said strands of beads.

4. The snare system for a snare drum of claim 2, further including a plurality of tension members.

5. The snare system for a snare drum of claim 4, wherein said plurality of tension members include at least one head contact member.

6. The snare system for a snare drum of claim 5, wherein said head contact member is selected from the group consisting of coils, beads, ball chain and combinations thereof.

7. The snare system for a snare drum of claim 5, wherein said head contact member creates a different sound depending upon said head contact member composition, said contact member physical size, and said contact member structure.

8. The snare system for a snare drum of claim 2, wherein selected ones of said plurality of tension members have a different tension.

9. The snare system for a snare drum of claim 8, wherein a spacer member is selected from the group consisting of a bar, and a disc or pulley rotatably mounting on a spindle held normal to said tension members to vary the tension of said selected tension members.

10. The snare system for a snare drum of claim 2, wherein said resilient material of said stretcher panel is selected from the group consisting of a fiberglass, a metal, an aluminum, a galvanized steel, an anodized steel, a brushed steel, a copper metal, a metal alloy, a stainless steel, a brass, a carbon fiber, a graphite material, a polymer, a polycarbonate, a high impact polymer, and a mirrored plastic.

11. The snare system for a snare drum of claim 2, wherein said tension member holding means comprises a plurality of slots defining teeth formed along a width of at least one opposing distal end of said stretcher panel.

12. The snare system for a snare drum of claim 2, said opposing stretcher panel attachment means comprising at least one aperture formed at least one selected location at each end of said stretcher panel for cooperatively engaging a bracket extending from said strap.

13. The snare system for a snare drum of claim 2, including a stainer in cooperative engagement with said belt and said drum.

14. The snare system for a snare drum of claim 2, wherein said tension member comprises a crimped wire, a wire helix, and a coil segments.

15. The snare system for a snare drum of claim 2, further including a means of adjusting the tension of said tension member comprising a bolt in cooperative engagement with said bracket and said tension member for rotating and adjusting tension os said strap.

16. The snare system for a snare drum of claim 2, wherein at least one of said first and second distal end of said longitudinal stretcher panel is bent upward at a selected angle toward said tension member and outward at a selected angle forming a step extending along an edge of said stretcher panel, said step includes a plurality of spaced apart slots defining teeth for cooperatively engaging said distal ends of said tension members and holding said tension member a selected distance from a concave surface of said stretcher panel.

17. The snare system for a snare drum of claim 16, wherein said teth are bent or angled downward with respect to a longitudinal stretcher member surface at a selected angle of about 90 degrees and said teeth extend about three-sixteenths to one-quarter of an inch from said distal end of said longitudinal stretcher, said teeth bending outwardly at a selected angle of about 90 degrees extending outward generally parallel to said surface of said longitudinal stretcher member.

18. The snare system for a snare drum of claim 16, wherein said slots are sized to received said tension members wedged therebetween and hold said contact members in position.

* * * * *